United States Patent [19]

Brandt et al.

[11] Patent Number: 4,805,793

[45] Date of Patent: Feb. 21, 1989

[54] STACKABLE BOTTLE

[75] Inventors: Charles M. Brandt, Douglassville; Donald P. Denhoff, Marietta; C. Joe Everett, Marietta; Donald F. Murray, Marietta, all of Ga.; William H. Wilson, Sparta, N.C.

[73] Assignee: Pioneer/Eclipse Corporation, Sparta, N.C.

[21] Appl. No.: 115,152

[22] Filed: Oct. 23, 1987

[51] Int. Cl.[4] ..... B65D 1/02; B65D 21/02; B65D 23/10

[52] U.S. Cl. ..... 215/10; 215/1 C; 215/100 A; 206/509; 206/510; 222/143

[58] Field of Search ..... 215/10, 1 C, 100 A; 206/509, 510, 511, 499; 222/143; D9/411, 408, 370

[56] References Cited

U.S. PATENT DOCUMENTS

| | | | |
|---|---|---|---|
| 3,369,688 | 2/1968 | Dike | 215/10 |
| 4,609,106 | 9/1986 | Gentili | 215/10 X |

FOREIGN PATENT DOCUMENTS

| | | | |
|---|---|---|---|
| 257189 | 1/1965 | Australia | 206/510 |
| 106722 | 3/1967 | Denmark | 215/10 |
| 2287387 | 5/1976 | France | 215/10 |
| 629148 | 4/1982 | Switzerland | 206/510 |

*Primary Examiner*—Sue A. Weaver
*Attorney, Agent, or Firm*—Wigman & Cohen

[57] ABSTRACT

A blow molded container for liquids is vertically stackable with geometrically similar containers. Each container has a unitary body formed of an extruded parison the thermoplastic material. The containers have a bottom surface which includes a release groove bifurcating the bottom surface, the release groove including a remnant portion of the parison forming a web-like external rib depending downward within the release groove. A top surface of the container includes an opening closed by the cap and includes a notch which receives the remnant portion of the parison of a geometrically similar container stacked thereon to laterally locate and stabilize the relative positions of the stacked containers.

10 Claims, 2 Drawing Sheets

STACKABLE BOTTLE

The present invention is directed to containers in the nature of bottles which are blow molded of thermoplastic material and adapted for stacking one upon another to permit palletizing and advantageous display of surface indicia present on the containers.

BACKGROUND AND SUMMARY OF THE INVENTION

Blow molded plastic bottles are well known and come in a variety of sizes and shapes to contain a wide variety of liquid, commercial and consumer products. While many bottles are boxed in cases or cartons for shipment, in more recent years attention has been paid to designing bottles which have sufficient strength so as to not require the protection and support afforded by other packaging materials. The containers of the present invention are designed to be stacked on a pallet and held in place by means of shrink-wrap applied to the pallet and containers.

Blow molded containers of consumer products are often used to construct point of sale displays involving multiple layers of the containers. It is therefore necessary that the containers have the required strength and stability to be stacked and thereby present to the purchasing public an attractive yet safe and stable display. The preferred embodiment of the present invention is intended to be so constructed as to require that each layer of stacked containers be rotated about a vertical axis by 90° and thereby display more than a single face or side panel of the container to the prospective purchaser.

A container constructed in accordance with the present invention has a unitary body formed of a thermoplastic material such as high density polyethylene. Other materials suitable for use in forming such a container include the whole range of thermoplastic resins usable in blow molding. The container is molded in the form of a unitary body having a bottom surface, a sidewall, and a top surface including an opening which can be closed by a cap or other closure means. In the preferred embodiment, the closure is a screw threaded plastic cap of conventional design which can be used to open and re-seal the container any number of times.

The bottom surface of a container constructed in accordance with the present invention has a recessed portion which includes a web-like external rib depending downwardly within the recessed portion. The web-like external rib can be formed by the pinch-off of the extruded parison. The top surface of the container according to the present invention includes notch means for receiving the external rib of a geometrically similar container stacked thereon so as to laterally locate and stabilize the relative positions of the stacked containers.

In a preferred embodiment the recess portion of the bottom surface of the container includes a release groove bifurcating the bottom surface of the container. The external rib intersects the middle of the release groove. The top surface includes a handle to permit the container to be lifted and carried. The notch means is preferably situated on a upper surface of the handle.

One feature of the present invention is the existence of a notch means on the top surface of a container for receiving a web-like external reinforcing rib located on the bottom surface of a geometrically similar container. The receiving of the external reinforcing rib on the bottom surface of an upper container into a notch means on the top surface of a lower container causes the containers to be laterally located and stabilized with respect to each other thereby permitting the containers to be more readily stacked for shipment and display.

Another feature of the present invention is the formation of the rib within a recess bifurcating the bottom surface of the container the recess being of such a size that no substantial vertical loading of the container occurs in the region of the rib. This has the advantage of locating a major proportion of the vertical loading on the portion of the bottom which straddles the recess thereby distributing the vertical load over a larger area and reducing local stress to the container.

Yet another feature of the present invention is the location of the web-like external reinforcing rib on the bottom surface and notch means on the top surface such that they are arranged orthogonally with respect to each other. Such orthogonal arrangement has the advantage of requiring that the bottles be axially rotated with respect to each other when stacked so as to permit a better display of labels and other external indicia which might appear on the bottles.

Other features and advantages of the present invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
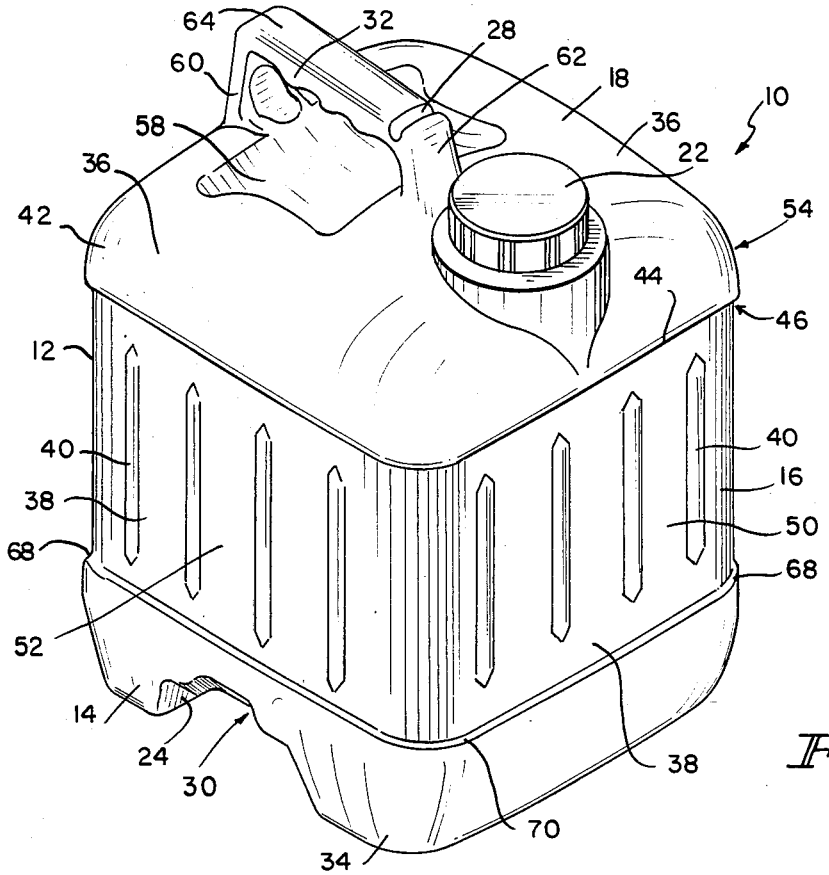
FIG. 1 is a perspective view showing the top and two sides of a container according to the present invention.
Figure 3:
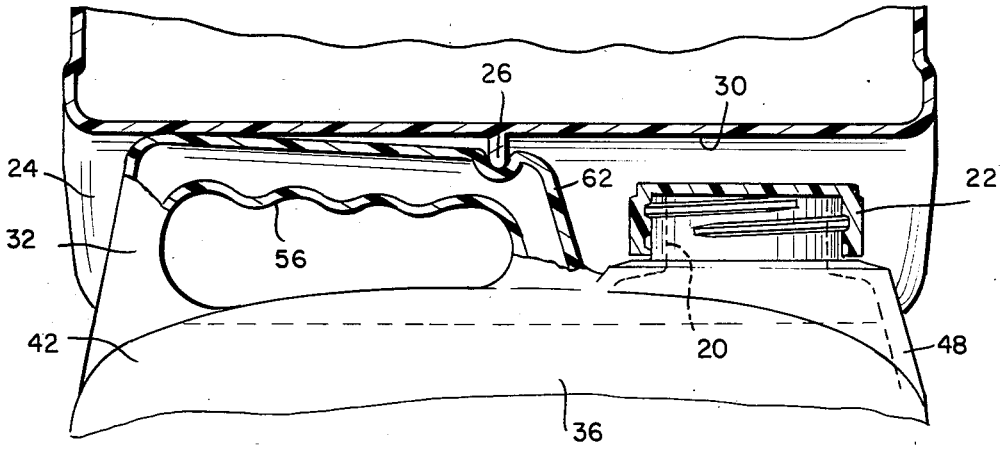
FIG. 3 is a partial sectional view taken along line 3—3 of FIG. 2.

A blow molded container 10 which is vertically stackable with geometrically similar containers is illustrated in the accompanying figures and in each figure like numerals are employed to designate like parts. The illustrated container 10 has a unitary body 12 formed of thermoplastic material by blow molding having a bottom surface 14, a sidewall 16, and a top surface 18. The top surface includes a threaded opening 20 sealed with a threaded cap 22. The top surface 18 includes a gently round shoulder 42 terminating in a generally square perimeter 44 having rounded corners 46.

The opening 20 is provided at the top of a short neck 48 which is offset toward a side of the container which, for convenience, will be referred to as the container front 50. A handle 32 is provided on the top surface which is aligned with the opening 20 the handle and opening being situated on a midline between the two side surfaces 52 and 54. The handle 32 includes on an underside undulations 56 which allow for a more positive grip on the container 10. The top surface 18 of the container is shown to be generally convex except in the region 58 below the handle where the top surface is slightly concave. The back 60 of the handle 32 is unitarily joined to the shoulder 42 of the top surface 18 while the front 62 of the handle 32 is unitarily joined to the top surface just forward of the front-to-back midline of the bottle. The top surface 64 of handle 32 is broken by a notch means 28 which is situated on the front-to-back midline of the bottle. The function of the notch means will become apparent in further discussion.

The sidewalls 16 are each generally rectangular panels extending from a stepped junction 66 with perimeter 44 downwardly to a lower perimeter 68 where each sidewall unitarily joins the bottom surface 14 with yet another stepped junction 70. The rectangular panels 38 are smoothly joined to the adjacent rectangular panels to form a belt-like sidewall 16 which extends completely around the container. The smooth sidewall 16 is periodically interrupted by a plurality of parallel, vertically oriented, strengthening ribs 40 which act to enhance the stackability of the container 10. A label (not shown) can be conveniently applied to overlie the sidewall 16 between the stepped junctions 66 and 70. The label can be made of a material sufficiently opaque so as to disguise or hide the existence of the strengthening ribs 40 if so desired.

The bottom surface 14 of the container is bifurcated by release groove 30 which forms a recessed portion 24 on the bottom surface of the container. The release groove 30 is situated on the front-to-back midline of the container and is orthogonal to the handle 32. On either side of the release groove 30 are load bearing portions 34 which define the bottom most surface of the container.

Figure 4:
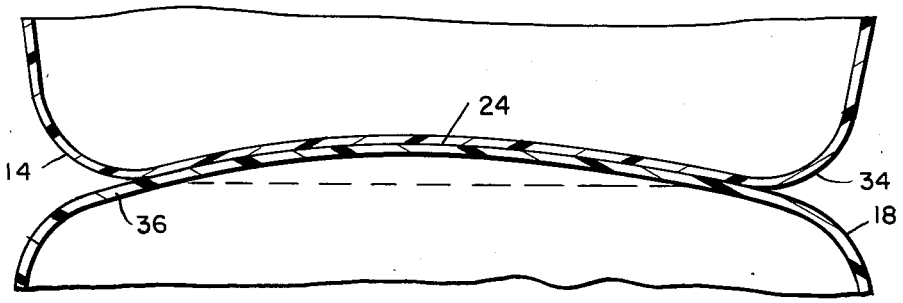
FIG. 4 is a detailed sectional view taken along line 4—4 of FIG. 2.

Each of the load bearing portions 34 is shown to be slightly concave so as to uniformly contact the rounded load supporting portions 36 of the top surface 18 when the bottles are stacked. The surfaces 34 and 36 are shown in FIG. 4 to define a smoothly mating junction between a lower and upper container of similar geometry.

The release groove 30 is interrupted by a downwardly extending external rib 26 which is an artifact of the blow molding process whereby a remnant portion of the extruded parison is left in place at the central pinch off zone so as to strengthen the overall characteristics of the bottom surface 14. In particular, the rib 26 acts in part to reduce any tendency on the part of the bifurcated load-bearing portions 34 from splaying when loaded.

Figure 2:
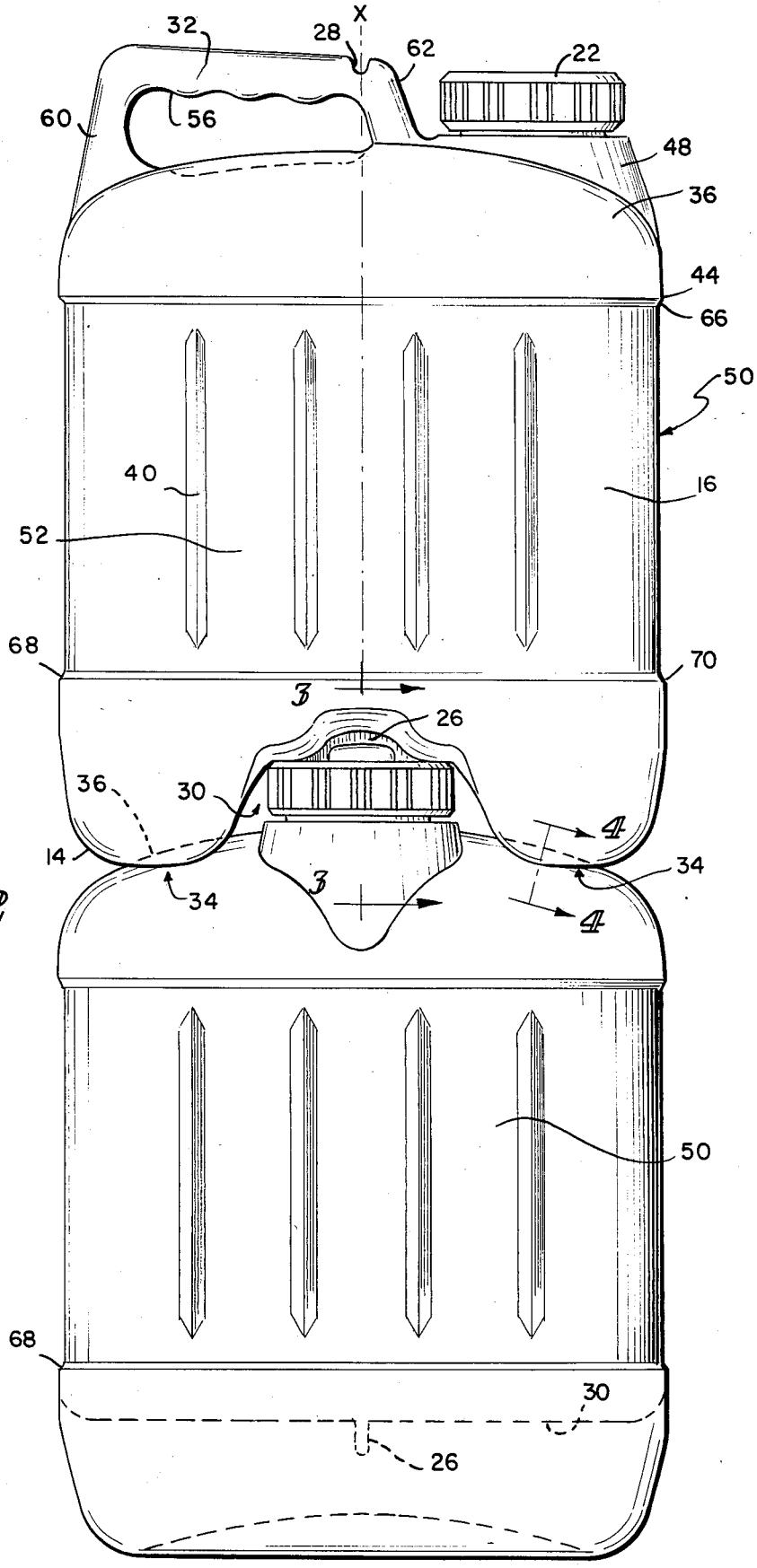
FIG. 2 is a side elevation view of two containers of the present invention stacked one upon the other.

The rib 26 of the upper bottle engages the notch means 28 of the lower bottle to laterally locate and stabilize the relative positions of the two containers. The vertical height of the handle 32 and depth of the notch means 28 is selected such that the strengthening rib 26 does not experience any significant amount of vertical loading, the load being borne essentially entirely by the cooperating load bearing portion 34 on the upper bottle and load supporting portion 36 on the lower bottle. As illustrated in FIG. 2, the vertically stacked containers are rotated about axis X and orthogonally oriented with respect to each other such that the side face 52 of an upper bottle overlies a front face 50 of a lower bottle.

Although the invention has been described in detail with reference to the illustrated preferred embodiment, variations and modifications exist within the scope and spirit of the invention as described and as defined in the following claims.

What is claimed is:

1. A blow molded container which is vertically stackable with geometrically similar containers, each container comprising a unitary body formed of a thermoplastic material having a bottom surface, a generally rectangular sidewall and a top surface including a handle and an opening closed by a cap, said handle and opening being arranged along a first plane midway between and parallel to a first pair of opposing walls of said sidewall and perpendicular to a second pair of opposing walls of said sidewall, said bottom surface having a recessed portion including a release groove bifurcating the bottom surface into two load-bearing portions straddling the release groove, said release groove having a stepped profile from end-to-end thereof and being arranged along a second plane orthogonal to said first plane midway between and parallel to said second pair of opposing walls, a first portion of said release groove having a width along the entire longitudinal extent thereof sufficient to receive therein the opening and cap of an underlying one of said containers, a second portion of said release groove having a width along the entire longitudinal extent thereof less than the width of the first portion and sufficient to receive therein the handle of an underlying one of said containers, said first groove portion being in closer proximity to the bottom surface of the container than said second groove portion, both said handle and said opening and cap being disposed completely within the release groove of an overlying one of said containers, said release groove including a web-like external rib depending downwardly from the second portion of the release groove, said handle including notch means for receiving the external rib of an overlying one of said containers to laterally locate and stabilize the relative positions of the containers.

2. The blow molded container of claim 1 wherein said notch means is arranged in said second plane.

3. A blow molded container which is vertically stackable with geometrically similar containers, each container comprising a unitary body formed of a thermoplastic material and having a bottom surface, a sidewall and a top surface including a handle and an opening closed by a cap, said handle and opening being arranged along a first plane, said bottom surface having a recessed portion including a release groove bifurcating the bottom surface into two load-bearing portions straddling the release groove, said release groove having a longitudinal axis arranged along a second plane substantially perpendicular to the first plane, said release groove having a stepped profile in said first plane extending from end-to-end of said groove, a first portion of said release groove having a width along the entire longitudinal extent thereof sufficient to receive therein the opening and cap of an underlying one of said containers, a second portion of said release groove having a width along the entire longitudinal extent thereof less than the width of the first portion and sufficient to receive therein the handle of an underlying one of said containers, said first groove portion being in closer proximity to the bottom surface of the container than said second groove portion, both said handle and said opening and cap being disposed completely within the release groove of an overlying one of said containers, said release groove including a web-like external rib depending downwardly from the second portion of the release groove, said handle including notch means for receiving the external rib of an overlying one of said containers to laterally locate and stabilize the relative positions of the containers.

4. The blow molded container of claim 3 wherein the top surface includes two longitudinal load-supporting portions adapted to contact the load-bearing portions of the bottom surface of a vertically stacked container.

5. The blow molded container of claim 4 wherein the position of the load-supporting portions with respect to the notch means is such that no substantial vertical loading of the container occurs in the region of the rib.

6. The blow molded container of claim 3 wherein the rib is situated orthogonally with respect to the notch means on each container so that when stacked the containers are alternately oriented about a vertical axis.

7. The blow molded container of claim 3 wherein the sidewall comprises four generally rectangular panels of the same size unitarily joined to the top and bottom surfaces each of which have an essentially square perimeter.

8. The blow molded container of claim 7 wherein each of said side panels includes a plurality of vertically oriented parallel strengthening ribs.

9. The blow molded container of claim 3 wherein said sidewall is generally rectangular and has a first pair of opposing walls and a second pair of opposing walls, the first pair of opposing walls being equi-spaced from and parallel to said first plane and the second pair of opposing walls being equi-spaced from and parallel to said second plane.

10. The blow molded container of claim 9 wherein said notch means is arranged in said second plane.

* * * * *